US007946083B2

(12) United States Patent
Kirby

(10) Patent No.: US 7,946,083 B2
(45) Date of Patent: May 24, 2011

(54) WHEELCHAIR RAMP FOR SHOWER ACCESS

(76) Inventor: Mark E. Kirby, Clearwater, FL (US)

( * ) Notice: Subject to any disclaimer, the term of this patent is extended or adjusted under 35 U.S.C. 154(b) by 64 days.

(21) Appl. No.: 12/478,268

(22) Filed: Jun. 4, 2009

(65) Prior Publication Data

US 2010/0307096 A1 Dec. 9, 2010

(51) Int. Cl.
*E04F 11/16* (2006.01)

(52) U.S. Cl. ..... 52/177; 52/174; 4/604; 4/613

(58) Field of Classification Search ..... 52/174, 52/175, 176, 459, 211, 831, 836, 846; 14/69.5, 14/71.1, 72.5; 4/604, 613
See application file for complete search history.

(56) References Cited

U.S. PATENT DOCUMENTS 3,713,553 A * 1/1973 Curtis et al. ..... 414/537
4,368,553 A * 1/1983 Perry ..... 14/69.5
4,912,796 A * 4/1990 Crump ..... 14/69.5
5,299,330 A * 4/1994 Moore et al. ..... 4/604
5,341,533 A * 8/1994 Seitz ..... 14/69.5
5,446,937 A * 9/1995 Haskins ..... 14/69.5
5,463,780 A * 11/1995 Harris et al. ..... 4/604
5,483,715 A * 1/1996 Fogarty et al. ..... 14/69.5
6,139,249 A * 10/2000 Lucht ..... 414/537
7,013,518 B2 * 3/2006 Leblanc ..... 14/69.5
7,082,637 B1 * 8/2006 Griffin ..... 14/69.5
7,114,210 B2 * 10/2006 Heinz ..... 14/69.5
7,237,294 B2 * 7/2007 Lensing ..... 14/69.5
7,430,775 B2 * 10/2008 Allen ..... 14/69.5
2009/0188035 A1 * 7/2009 Luxton et al. ..... 4/604

* cited by examiner

*Primary Examiner* — Brian E Glessner
*Assistant Examiner* — Adam Barlow
(74) *Attorney, Agent, or Firm* — Ronald E. Smith; Smith & Hopen, P.A.

(57) ABSTRACT

A frame for building a ramp provides wheelchair users ingress and egress to a shower area. A first embodiment includes a first flat inclined surface and an arcuate surface. In a second embodiment, the frame has first and second flat inclined surfaces having first and second inclinations, respectively, and an arcuate surface. A third embodiment adds a third flat inclined surface having a third inclination and includes the arcuate surface. A first set of screw mounts is formed adjacent a lowermost end of the frame, a second set of screw mounts is formed in the frame at a predetermined elevation above the first set of screw mounts and a set of stabilizing legs is formed in the arcuate surface at the predetermined elevation. The frame may be cut to lower its profile.

6 Claims, 13 Drawing Sheets

WHEELCHAIR RAMP FOR SHOWER ACCESS

BACKGROUND OF THE INVENTION

1. Field of the Invention

This invention relates, generally, to the construction arts. More particularly, it relates to a ramp that provides access for wheelchairs into a bathroom shower space.

2. Description of the Prior Art

A shower stall or space is typically separated from a bathroom by a short vertical shower curb that substantially prevents water from splashing from the shower floor onto the bathroom floor. It presents a barrier to wheelchair users. Accordingly, it is common practice to build a ramp over such a curb to provide wheelchair access to the shower.

Most construction codes include requirements that govern the slope of shower stall floors. A floor with no slope is the safest to stand upon but it has poor drainage qualities. Thus, a compromise is made between a level floor with poor drainage and a steeply sloped floor that provides good drainage but unsafe support. Most construction codes have settled upon a slope of a quarter inch of slope per lineal foot.

The size of the shower thus has an effect on any ramp structure that is built to provide wheelchair access. For example, a shower having a drain that is four feet from the shower border will have a one inch rise from the drain to the border. A shower having a drain that is six feet from the border will have a one and a half inch rise from the drain to the border. The height of the shower floor at the shower/bathroom border thus increases with distance from the drain. Since the drain is in the same horizontal plane as the bathroom floor, the shower floor will join a ramp at differing heights.

Although a ramp may be custom-built for each job, it would be advantageous for the industry to have a standard structure that could be used in every situation, ranging from very large to very small showers where the drain may be positioned far from or very close to the shower/bathroom border. The materials used to build the ramp should be strong but light-in-weight and the ramp should be adjustable in height to meet varying requirements. The descending part of the ramp, i.e., the part that descends from the highest point in the ramp to the shower floor, should have a structure that ensures there are no abrupt changes in inclination where said descending part of the ramp meets the sloped shower floor.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a ramp that can be used with showers of many differing sizes is now met by a new, useful, and non-obvious invention.

The inventive structure includes a frame for building a ramp that provides wheelchair users ingress and egress to a shower area. There are three basic frames for making three embodiments of the invention, each of which may be cut at two predetermined locations to produce a reduced-height version of that embodiment.

In all embodiments, the frame has a lattice or open mesh construction to facilitate filling the area bordered by the frame with concrete and covering the frame with concrete. The frame and hence the completed ramp has a width or length sufficient to simultaneously engage a pair of wheelchair wheels.

In a first embodiment, the frame has a first, flat inclined surface that ascends upwardly from a bathroom floor and a second, arcuate surface that descends downwardly to meet the sloped shower floor. The ascending and descending parts are formed integrally with one another to form the frame that is filled with concrete and covered with a thin layer of concrete upon which tile is laid to form a completed ramp.

In a second embodiment, the frame has a first, flat inclined surface and a second, inclined flat surface having first and second inclinations, respectively.

In a third embodiment, the frame has a first, flat inclined surface, a second inclined flat surface, and a third inclined flat surface having first, second, and third inclinations, respectively.

In all three embodiments, the frame may be cut at two predetermined locations to provide a ramp having a lower profile than the uncut embodiment.

The descending, arcuate side of the frame is the same in all three embodiments,

In all three embodiments, a first set of screw mounts is formed in the first flat, inclined surface adjacent a lowermost end of the first inclined, flat surface and a second set of screw mounts is formed in the ascending part of the ramp at a predetermined higher elevation than the first set of screw mounts. A set of stabilizing legs is formed in the arcuate part of the frame at the same elevation as the second set of screw mounts.

Each screw mount is adapted to receive a screw to secure the frame to a support surface. The second set of screw mounts and the set of stabilizing legs are used only when the frame is cut to lower its profile.

To create a lower profile version of each of the three embodiments, a first cut is made in the frame at the lowermost end of the second set of screw mounts and a second cut is made in the frame at a lowermost end of the set of stabilizing legs.

In the first embodiment, there is only one ascending, inclined flat surface. It is inclined at an angle of about one hundred seventy degrees (170°) relative to a level support surface.

In the second embodiment, the ascending side of the ramp has two inclined flat surfaces, the first being inclined at an angle of about one hundred seventy degrees (170°) relative to a level support surface and the second being inclined at an angle of about one hundred fifty degrees (150°) relative to a level support surface.

In the third embodiment, the ascending side of the ramp has three inclined flat surfaces. The first is inclined at an angle of about one hundred seventy degrees (170°) relative to a level support surface, the second is inclined at an angle of about one hundred fifty degrees (150°) relative to a level support surface, and the third is inclined at an angle of about one hundred thirty degrees (130°) relative to the support surface.

An important object of the invention is to provide a shower curb that can be used close to a shower drain or far from a shower drain in the absence of abrupt changes in inclination where the shower floor meets the descending part of the ramp.

Another object is to provide a light-in-weight and inexpensive frame that is used to build a shower curb.

Another important object is to provide a frame that can be cut to provide a ramp of limited height for those environments where a high ramp is not required.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
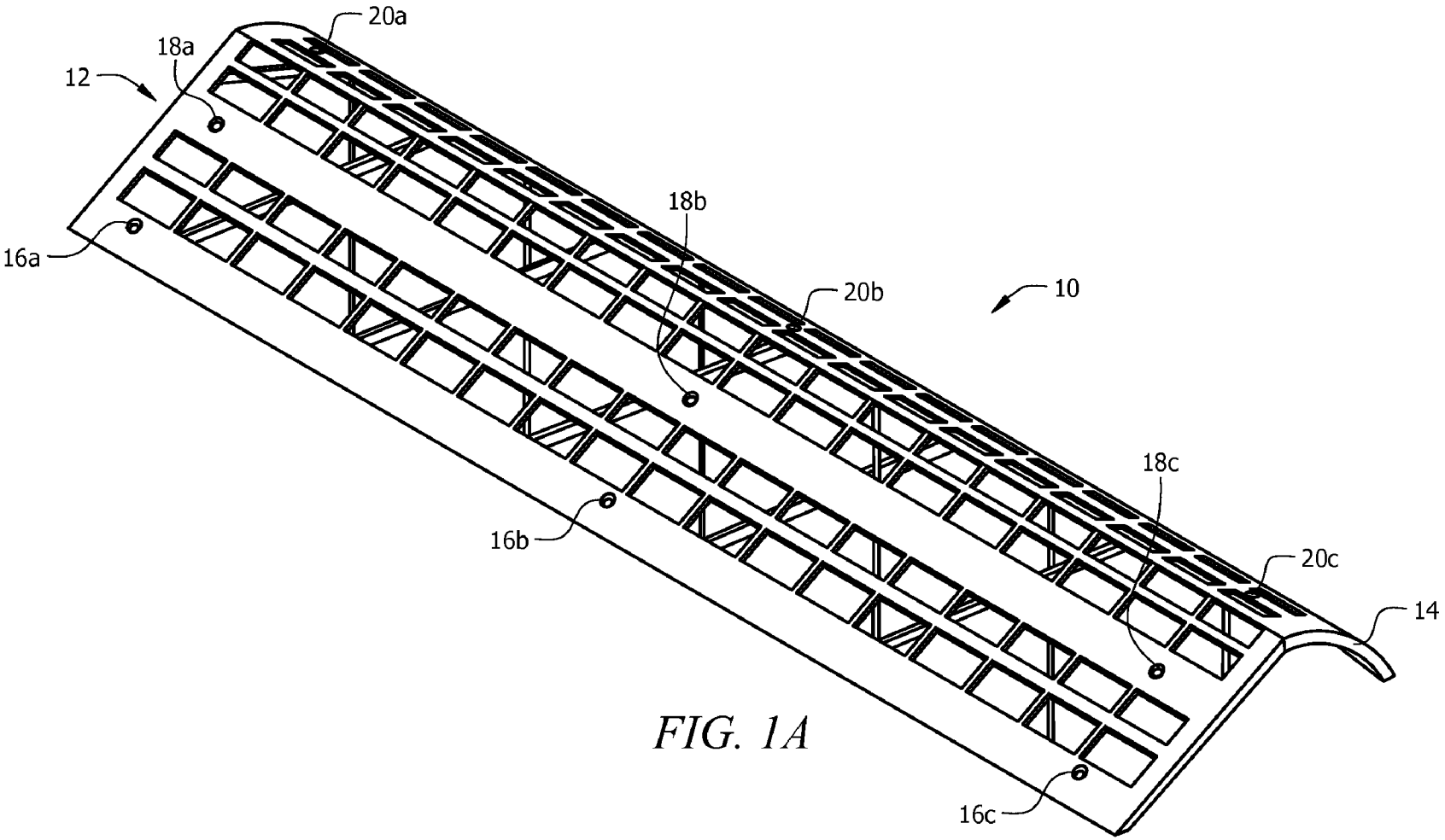
FIG. 1A is a perspective view of a first embodiment of the novel frame.

Referring now to FIG. 1A, it will there be seen that a first illustrative embodiment of the novel frame employed to build the novel ramp is denoted as a whole by the reference numeral 10.

In all embodiments of the invention, frame 10 is preferably made of high impact polystyrene (HIPS) but frames made with different materials are within the scope of this invention. High impact polystyrene is light-in-weight, inexpensive and easily cut.

In the first embodiment, frame 10 includes ramp 12 that has one (1) inclined flat surface denoted 12*a* and one arcuate surface denoted 14. From the perspective of a user in a wheelchair, flat surface 12*a* defines the ascending part of the ramp when construction is completed and arcuate surface 14 defines the descending part of the ramp, i.e., the part of the ramp that meets the inclined shower floor.

In a preferred embodiment, arcuate surface 14 is the arc of a circle as depicted but the invention is not limited to a perfectly circular arcuate part 14.

Figure 1B:
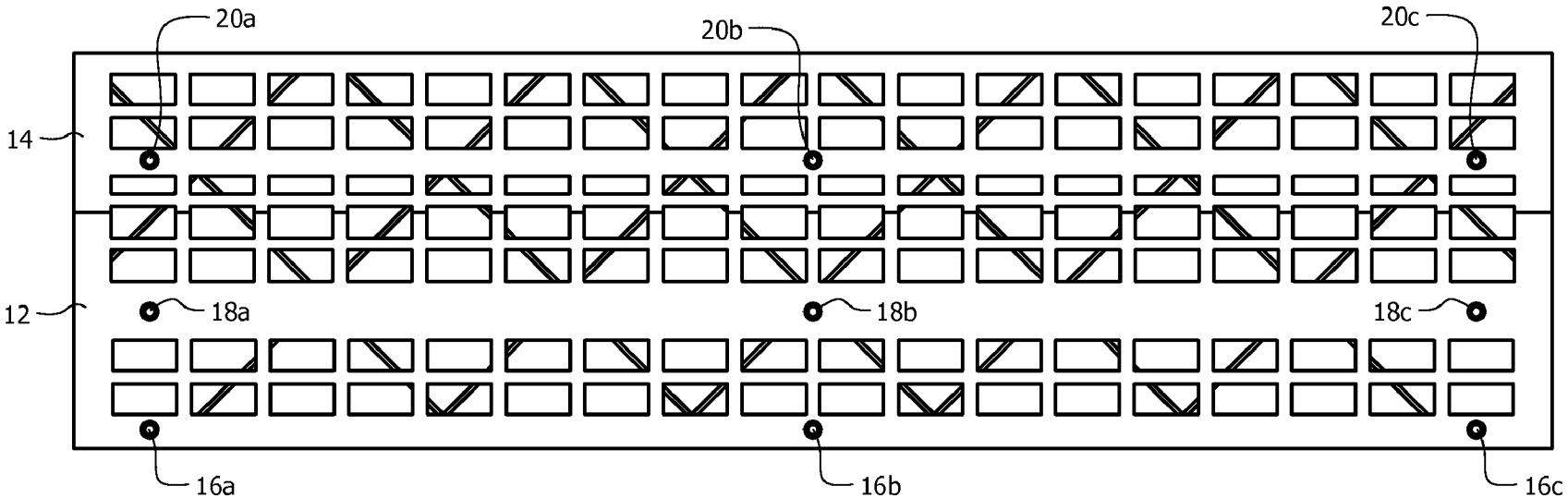
FIG. 1B is a top plan view of the first embodiment.
Figure 1C:
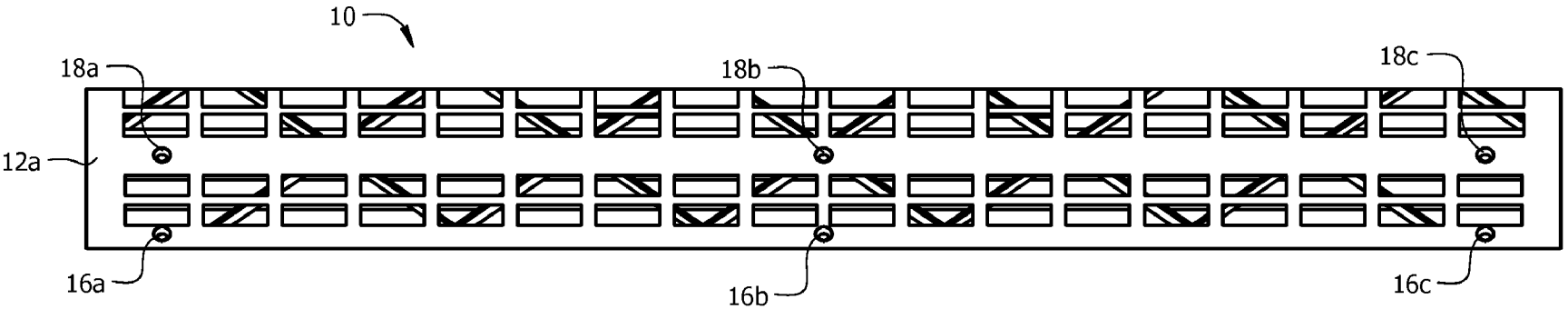
FIG. 1C is a front elevational view of the first embodiment.
Figure 1D:
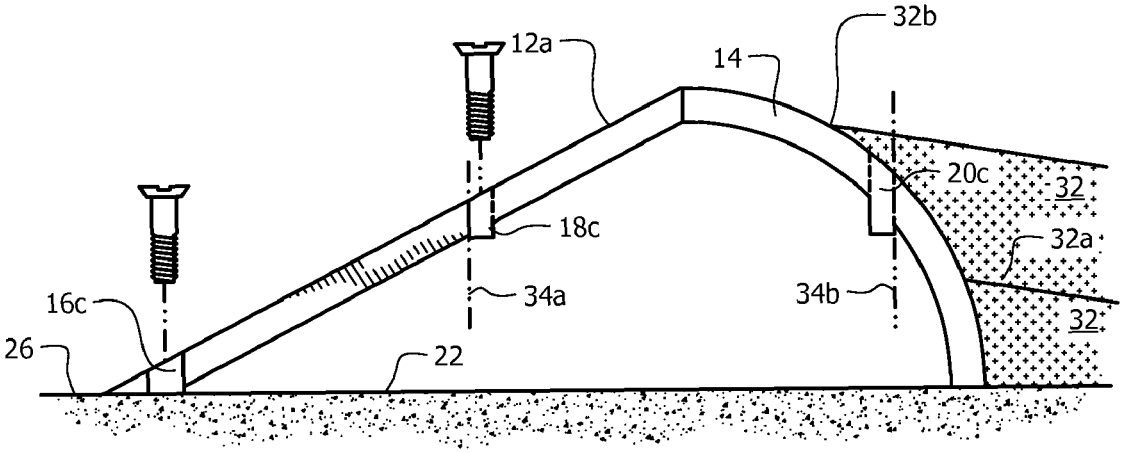
FIG. 1D is a side elevational view of the first embodiment.

Frame 10 has a rectangular profile in plan view and front elevation as depicted in FIGS. 1B and 1C, respectively. As best depicted in FIG. 1D, inclined flat surface 12*a* is inclined at an angle of about thirty degrees (30°) relative to bathroom floor 22.

Screw mounts 16*a*, 16*b*, and 16*c* are smoothly bored, preferably not internally threaded, to receive screws that fasten the frame to a bathroom floor surface. In this first embodiment, screw mounts 18*a*, 18*b*, and 18*c* are formed in the ascending part of the frame at a predetermined elevation above screw mounts 16*a*, 16*b*, and 16*c*. Stabilizing legs 20*a*, 20*b*, and 20*c* are formed in the descending, arcuate part of the frame at the same elevation as screw mounts 18*a*, 18*b*, and 18*c*. Said legs are solid and perform the function their name implies.

Figure 1E:
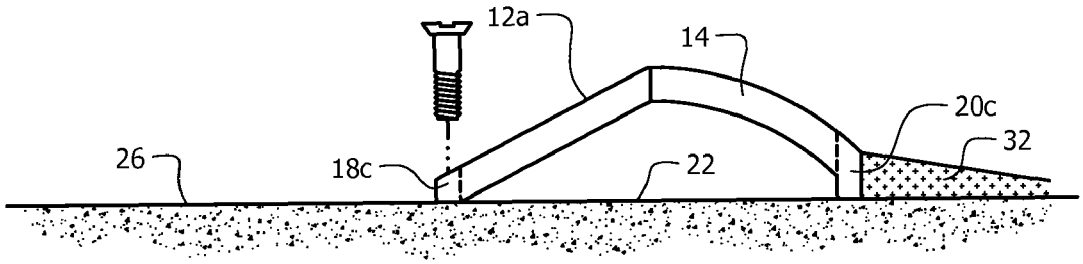
FIG. 1E is a side elevational view of the first embodiment after it has been cut to form a lower profile frame.

The low profile version of the first embodiment is depicted in FIG. 1E. Frame 12 is cut in a vertical plane at two locations. As depicted in FIG. 1D, the first cut 34*a* is made at the respective outboard ends of the second set of screw mounts 18*a*, 18*b*, and 18*c*, and the second cut 34*b* is made at the respective outboard ends of the stabilizing legs 20*a*, 20*b*, and 20*c*.

Figure 2A:
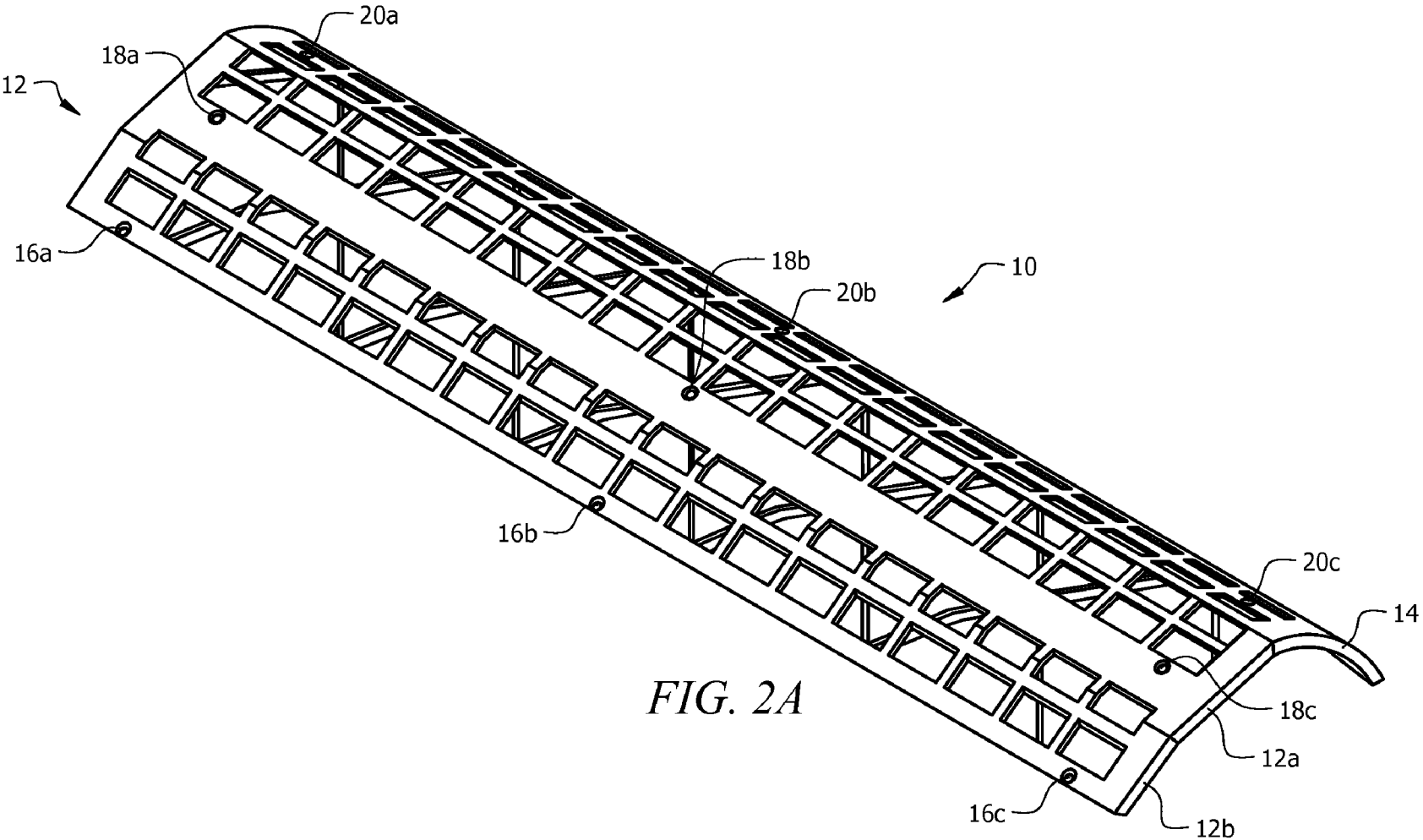
FIG. 2A is a perspective view of a second embodiment of the novel frame.
Figure 2B:
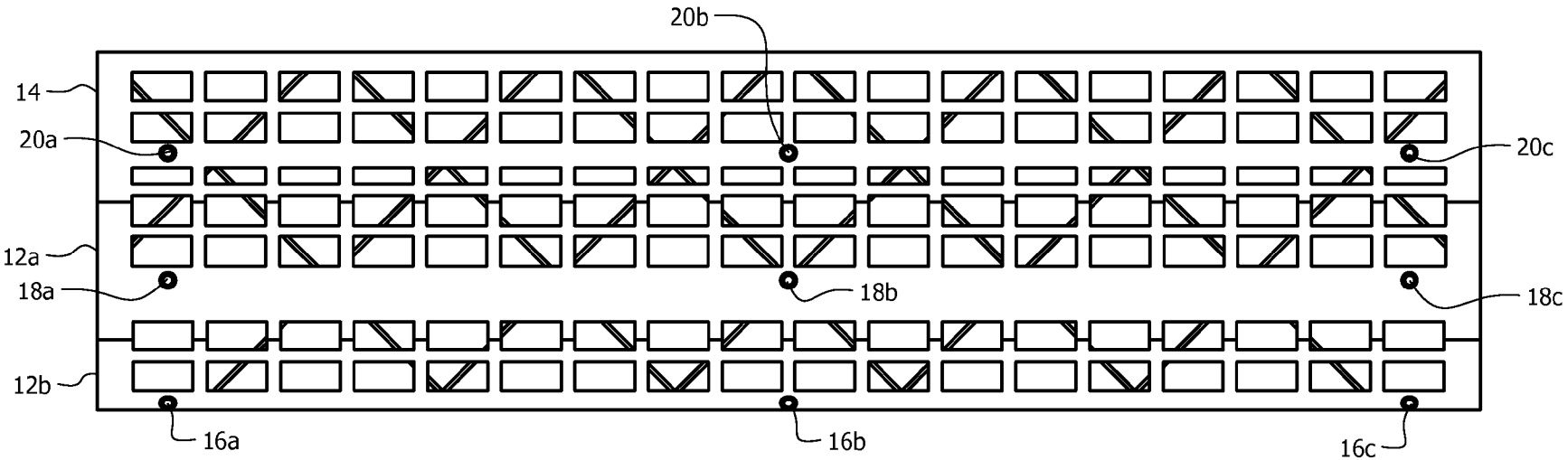
FIG. 2B is a top plan view of the second embodiment.
Figure 2C:
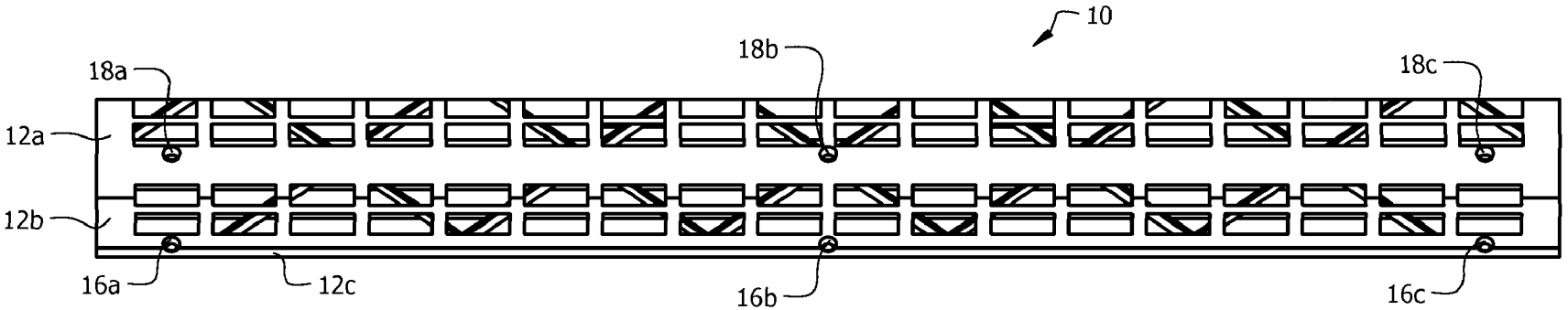
FIG. 2C is a front elevational view of the second embodiment.

A second embodiment is depicted in perspective in FIG. 2A, top plan view in FIG. 2B, and front elevation in FIG. 2C.

Frame 10 of the second embodiment includes ramp 12 that has two (2) inclined flat surfaces denoted 12*a* and 12*b* and one arcuate surface denoted 14. Inclined flat surface 12*a* is inclined at an angle of about twenty degrees (20°) and inclined flat surface 12*b* is inclined at an angle of about forty degrees (40°) relative to bathroom floor 22. The screw mounts of the second embodiment are located at substantially the same locations as in the first embodiment. More particularly, the second set of screw mounts 18*a*, 18*b*, and 18*c* is formed in the frame at the lowermost end of inclined flat surface 12*b*. The screw mounts of the third embodiment are located at substantially the same locations as in the second embodiment.

Figure 2D:
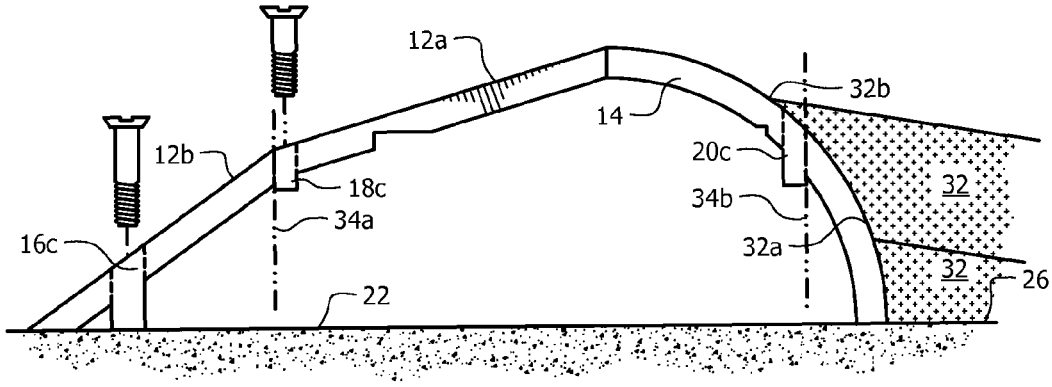
FIG. 2D is a side elevational view of the second embodiment.
Figure 2E:
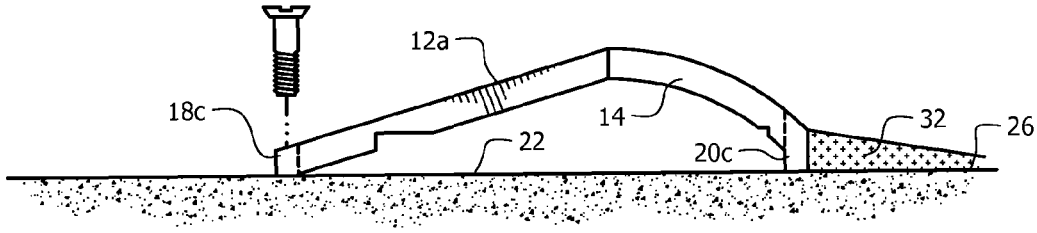
FIG. 2E is a side elevational view of the second embodiment after it has been cut to form a lower profile frame.

The low profile version of the second embodiment is depicted in FIG. 2E. As indicted in FIG. 2D, frame 12 is cut in a vertical plane at the same two locations 34*a*, 34*b* as in the first embodiment. A second embodiment is depicted in perspective in FIG. 2A, top plan view in FIG. 2B, and front elevation in FIG. 2C.

Figure 3A:
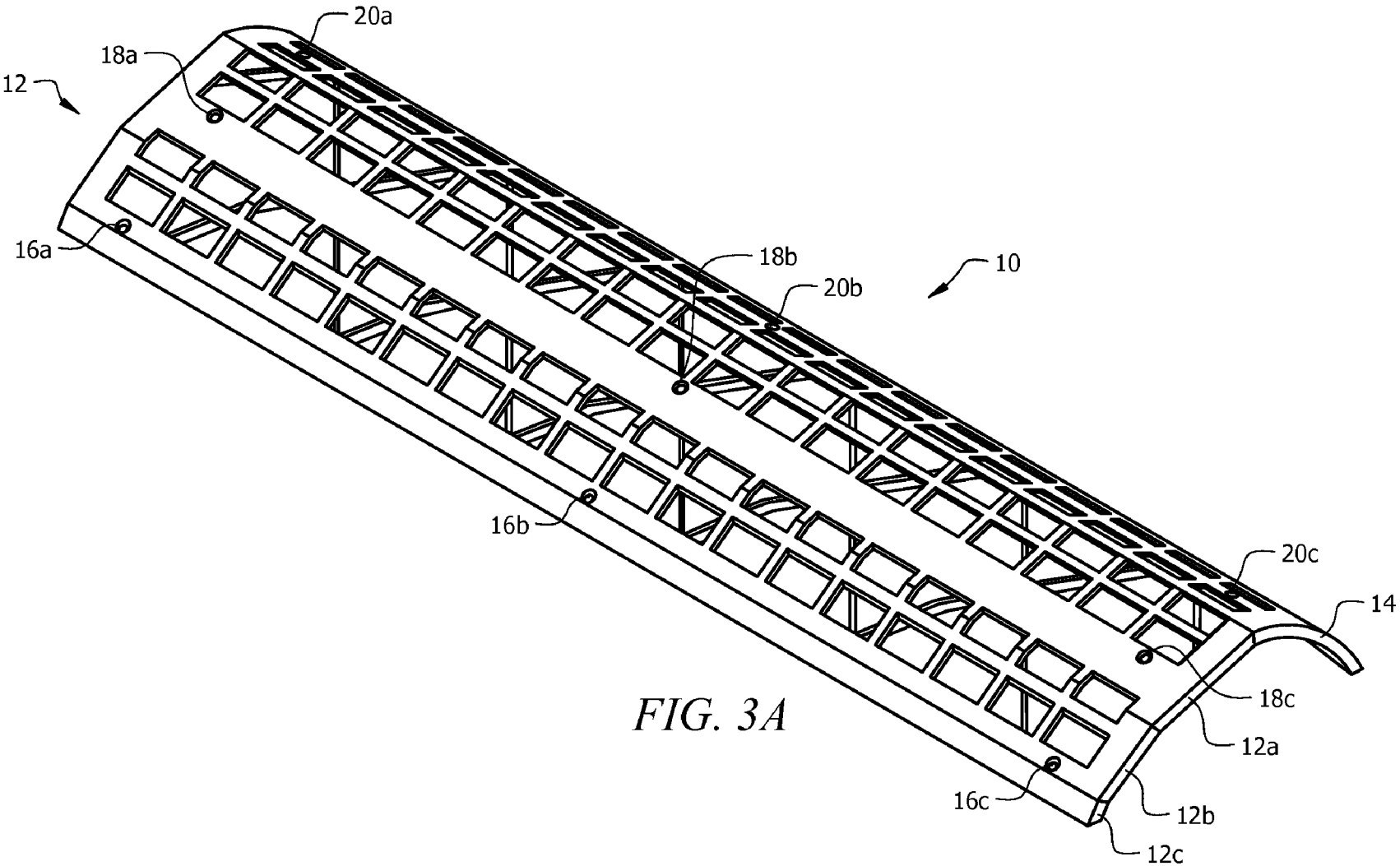
FIG. 3A is a perspective view of a third embodiment of the novel frame.
Figure 3B:
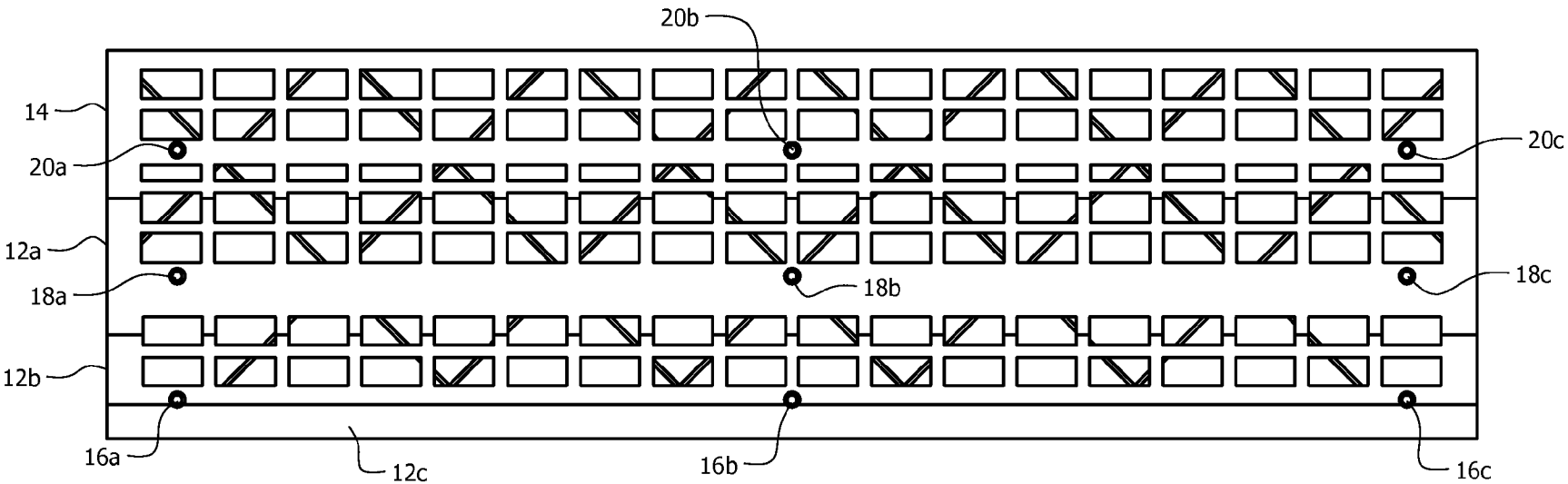
FIG. 3B is a top plan view of the third embodiment.
Figure 3C:
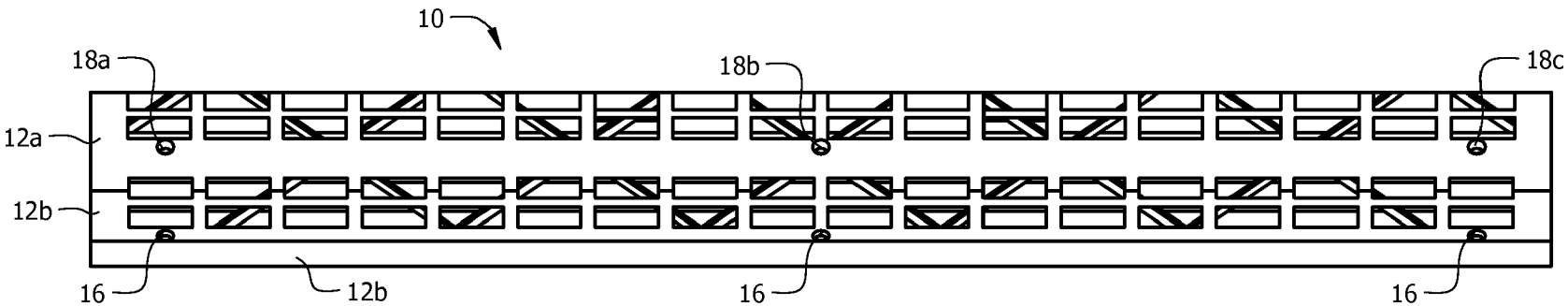
FIG. 3C is a front elevational view of the third embodiment.

A third embodiment is depicted in perspective in FIG. 3A, top plan view in FIG. 3B, and front elevation in FIG. 3C.

In the third embodiment, ramp 12 has three (3) inclined flat surfaces denoted 12*a*, 12*b*, and 12*c* and one arcuate surface denoted 14. Inclined flat surface 12*b* is inclined at an angle of about forty degrees (40°) relative to bathroom floor 22. Inclined flat surface 12*c* is inclined at an angle of about one hundred thirty degrees (130°) relative to bathroom floor 22. Inclined flat surface 12*c*, which has a truncate extent relative to surfaces 12 and 12*b*, is inclined at an angle of about sixty five degrees (65°) relative to bathroom floor 22.

Figure 3D:
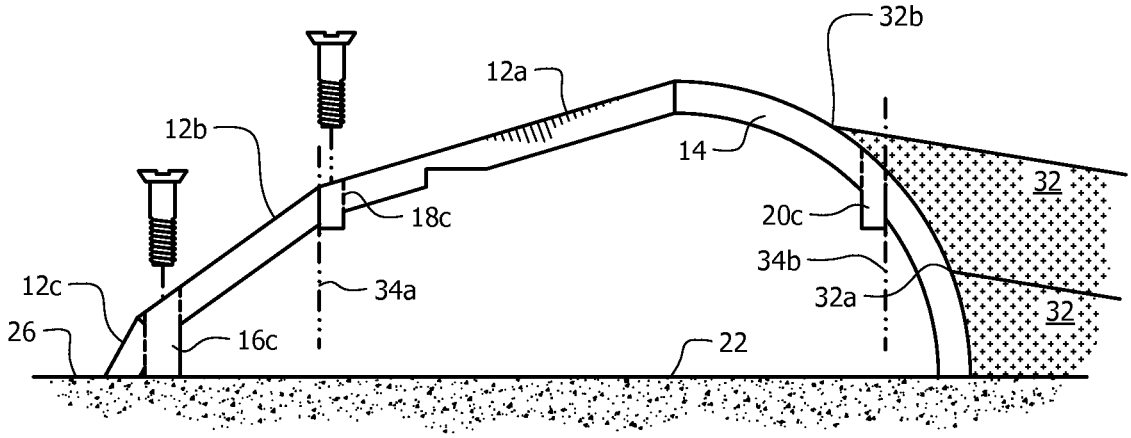
FIG. 3D is a side elevational view of the third embodiment.
Figure 3E:
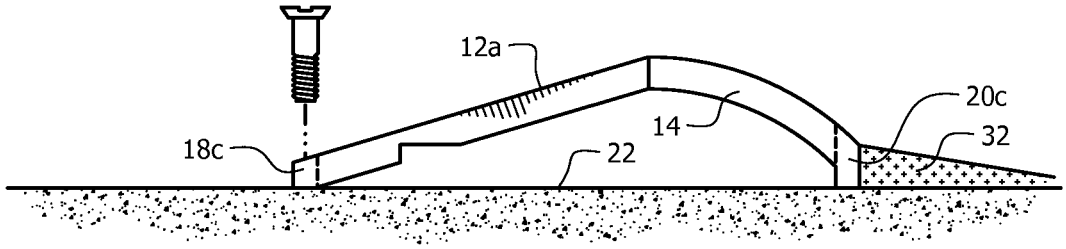
FIG. 3E is a side elevational view of the third embodiment after it has been cut to form a lower profile frame.

The low profile version of the third embodiment is depicted in FIG. 3E. Frame 12 is cut in a vertical plane at the same two locations 34*a*, 34*b* as in the first and second embodiments and as depicted in FIG. 3D.

Figure 4:
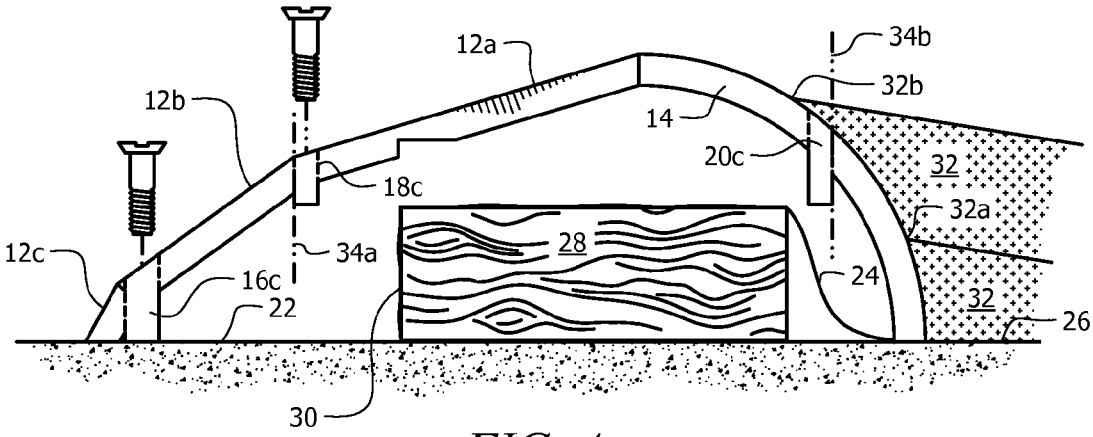
FIG. 4 is a side elevational view depicting the third embodiment of the novel frame in an environment where a shower liner underlies the frame.

There are two (2) conventional ways to line a shower floor to protect it from water. FIG. 4 depicts a first technique and FIG. 5 depicts a second technique.

In the technique of FIG. 4, vinyl liner 24 overlies shower floor 26 and underlies the trailing edge of arcuate frame part 14. A two inch by four inch (2"×4") board 28 overlies bathroom floor 22 and underlies vinyl liner 24. The free end of said vinyl liner is secured to said board as at 30. Cement 32, known in the industry as mud, overlies shower floor 26 and therefore overlies vinyl liner 24. The slope of the mud is typically one quarter inch per foot so the mud intersects arcuate part 14 at 32*a* if the shower drain is a first distance from frame 10 and said mud intersects arcuate part 14 at 32*b* if the shower drain is located a second distance from the shower drain that is greater than said first distance. Mud 32 may interest arcuate part 14 at an infinite number of locations along the extent of said arc. This enables novel ramp 10 to be used with showers of almost any size. If arcuate part 14 were a flat, inclined ramp, mud 32 could intersect it at an unacceptable, abrupt angle.

Figure 5:
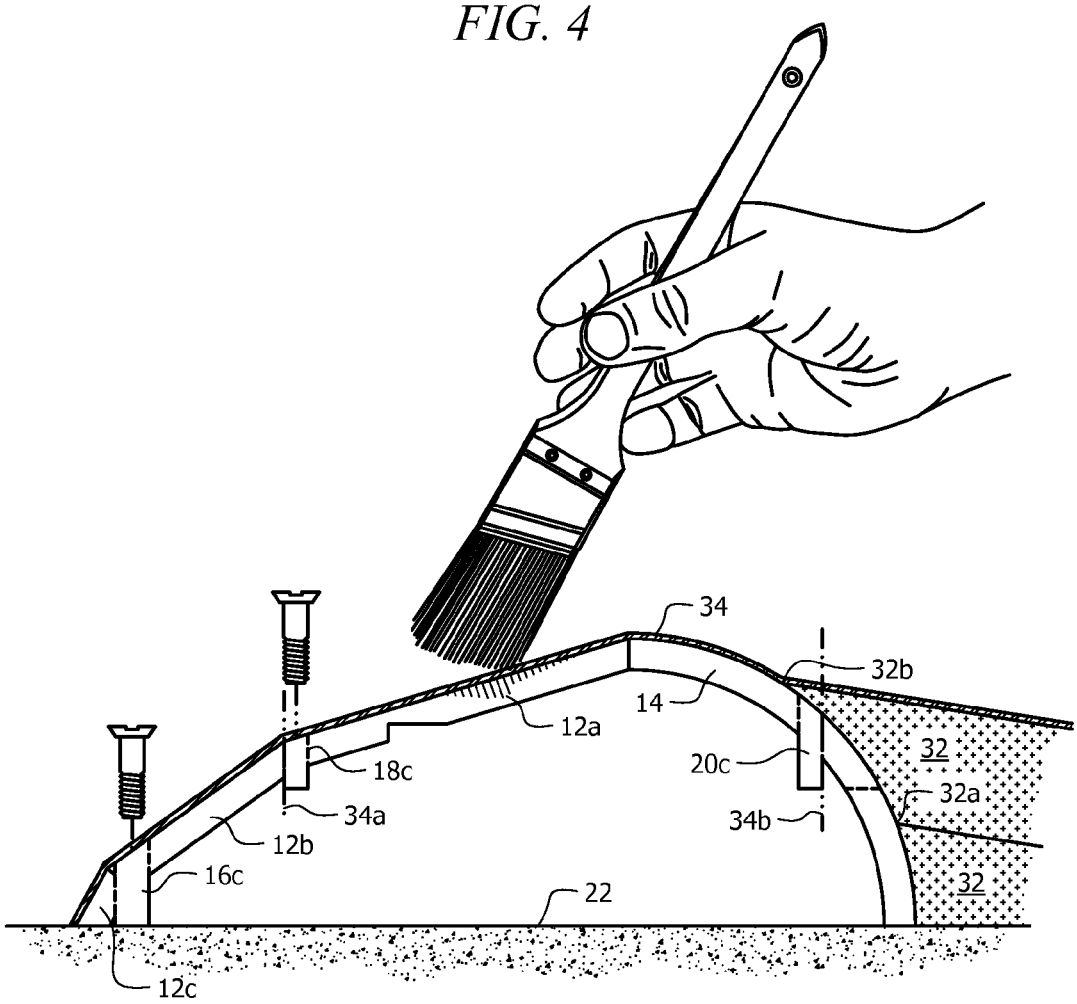
FIG. 5 is a side elevational view depicting the third embodiment of the novel frame in an environment where a shower liner overlies the frame.

In a second technique, depicted in FIG. 5, vinyl liner 24 and board 28 are not used. A liquid membrane liner 34 is rolled or brushed on the upper surface of mud 32 and the upper surface of frame 10.

In a third technique, not depicted, a fabric is applied so the brush of FIG. 5 is not needed. The fabric may be any suitable fabric that has been approved for use as a shower pan liner.

The novel structure has utility whether used with a vinyl liner 24, a roll or brush on liner 34, or a fabric liner. All of such liners provide the needed moisture barrier.

It is apparent from FIGS. 4 and 5 that arcuate section 14 is highly advantageous because it provides a good merger with mud 32 at all mud thicknesses, i.e., at all levels of mud 32/arcurate section 14 intersection. A good merger is a merger having no abrupt change in slope that could serve as an obstacle to a wheelchair user.

The fact that mud bed 32 may intersect arcuate section 14 at an infinite number of levels, depending upon the distance from a shower drain to said arcuate surface, enables an installer to purchase large numbers of frames 10 because said frames will fit almost if not all jobs.

In all embodiments, the longitudinal extent of the completed ramp exceeds the width of a conventional wheelchair. In a commercial embodiment, the length of each ramp frame 10 will be about thirty inches (30") but the ramp frames may be connected to one another in end-to-end relation and may be cut at any point to enable the making of ramps of any length.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A frame for building a ramp that provides wheelchair users ingress and egress to a shower area having sloped floors that direct water to a drain, comprising:

said frame having a first flat upwardly inclined surface and an arcuate downwardly inclined surface formed integrally with said first flat upwardly inclined surface to collectively form said ramp;

said ramp having a highest point where said first flat upwardly inclined surface meets said arcuate downwardly inclined surface;

said first flat upwardly inclined surface having a lowermost end and said arcuate downwardly inclined surface having a lowermost end, said respective lowermost ends being at a common elevation;

said frame having a lattice construction to facilitate covering said frame with concrete;

said frame secured to a support surface;

a first set of screw mounts and associated stabilizing legs formed in said first flat upwardly inclined surface adjacent a lowermost end of said first flat upwardly inclined surface;

each screw mount of said first set of screw mounts receiving a screw to secure said frame to said support surface;

a second set of screw mounts and associated stabilizing legs formed in said first flat upwardly inclined surface at a predetermined elevation above said first set of screw mounts;

a third set of screw mounts and associated stabilizing legs formed in said arcuate downwardly inclined surface at said predetermined elevation;

a first cutting line formed in said first flat upwardly inclined surface at a predetermined elevation above said first set of screw mounts;

a second cutting line formed in said arcuate downwardly inclined surface at said predetermined elevation;

each stabilizing leg associated with said second and third sets of screw mounts abutting said support surface when first and second cuts are made on said first and second cutting lines;

each screw mount of said second and third sets of screw mounts receiving a screw to secure said frame to a support surface when said first and second cuts are made on said first and second cutting lines;

said ramp extending over an obstacle having a first height when no cuts are made on said first and second cutting lines;

said ramp extending over an obstacle having a second height when said first and second cuts are made in said first and second cutting lines;

said first height being greater than said second height; and a layer of cementitious material intersecting with said arcuate downwardly inclined surface at any preselected height, said layer of cementitious material sloping downwardly at a predetermined rate as it extends away from said arcuate downwardly inclined surface toward said drain.

2. A frame for building a ramp that provides wheelchair users ingress and egress to a shower area having sloped floors that direct water to a drain, comprising:

said frame having a first flat upwardly inclined surface and a second flat upwardly inclined surface formed integrally with said first flat upwardly inclined surface, said first and second flat upwardly inclined surfaces having first and second inclinations, respectively;

said frame having an arcuate downwardly inclined surface formed integrally with said second flat upwardly inclined surface;

said frame having a lattice construction to facilitate covering said frame with concrete;

said frame secured to a support surface;

a first set of screw mounts and associated stabilizing legs formed in said second flat upwardly inclined surface adjacent a lowermost end of said second flat upwardly inclined surface;

each screw mount of said first set of screw mounts receiving a screw to secure said frame to a support surface;

a second set of screw mounts and associated stabilizing legs formed in said frame at a predetermined elevation where said first flat upwardly inclined surface meets said second flat upwardly inclined surface, said predetermined elevation being above said first set of screw mounts;

a third set of screw mounts and associated stabilizing legs formed in said arcuate surface at said predetermined elevation;

a first cutting line formed in said frame at said lowermost end of said second set of screw mounts;

a second cutting line formed in said frame at a lowermost end of said third set of screw mounts;

said frame having a first profile, relative to said frame prior to making first and second cuts in said first and second cutting lines;

said frame having a second profile, relative to said frame prior to making said first and second cuts, after said first and second cuts are made;

each stabilizing leg associated with said second and third sets of screw mounts abutting said support surface after said first and second cuts are made;

each screw mount of said second and third sets of screw mounts receiving a screw to secure said frame to a support surface after said first and second cuts are made;

said second profile being lower than said first profile; and a layer of cementitious material intersecting with said arcuate downwardly inclined surface at any preselected height, said layer of cementitious material sloping downwardly at a predetermined rate as it extends away from said arcuate downwardly inclined surface toward said drain.

3. A frame for building a ramp that provides wheelchair users ingress and egress to a shower area having sloped floors that direct water to a drain, comprising:

said frame having a first flat upwardly inclined surface, a second flat upwardly inclined surface, and a third flat upwardly inclined surface, said first, second, and third flat upwardly inclined surfaces being integrally formed to collectively form an ascending part of said ramp and having first, second, and third inclinations, respectively;

said frame having an arcuate downwardly inclined surface formed integrally with said third flat upwardly inclined surface;

said frame having a lattice construction to facilitate covering said frame with concrete;

said frame secured to a support surface;

a first set of screw mounts and associated stabilizing legs formed in said third flat upwardly inclined surface adjacent a lowermost end of said third flat upwardly inclined surface;

a screw received in each screw mount of said first set of screw mounts to secure said frame to a support surface;

a second set of screw mounts and associated stabilizing legs formed in said frame at a predetermined elevation about where said first flat upwardly inclined surface meets said second flat upwardly inclined surface, said predetermined elevation being above said first set of screw mounts;

a third set of screw mounts and associated stabilizing legs formed in said arcuate surface at said predetermined elevation;

a first cutting line formed in said frame at said lowermost end of said second set of screw mounts;

a second cutting line formed in said frame at a lowermost end of said third set of screw mounts;

said frame having a first profile relative to said frame prior to making first and second cuts at said first and second cutting lines, respectively;

said frame having a second profile relative to said frame prior to making said first and second cuts;

said second profile being lower than said first profile;

each stabilizing leg associated with said second and third sets of screw mounts abutting said support surface after said first and second cuts are made;

a screw received in each screw mount of said second and third sets of screw mounts to secure said frame to a support surface; and a layer of cementitious material intersecting with said arcuate downwardly inclined surface at any preselected height, said layer of cementitious material sloping downwardly at a predetermined rate as it extends away from said arcuate downwardly inclined surface toward said drain.

4. The frame of claim 1, further comprising:

said first flat upwardly inclined surface being inclined at an angle of about thirty degrees (30°) relative to a support surface.

5. The frame of claim 2, further comprising:

said first flat upwardly inclined surface being inclined at an angle of about twenty degrees (20°) relative to a support surface; and said second flat upwardly inclined surface being inclined at an angle of about forty degrees (40°) relative to a support surface.

6. The frame of claim 3, further comprising:

said first flat upwardly inclined surface being inclined at an angle of about twenty degrees (20°) relative to a support surface;

said second flat upwardly inclined surface being inclined at an angle of about forty degrees (40°) relative to a support surface; and said third flat upwardly inclined surface being inclined at an angle of about sixty five degrees (65°) relative to a support surface.

* * * * *